US008926352B2

(12) United States Patent
Wang et al.

(10) Patent No.: US 8,926,352 B2
(45) Date of Patent: Jan. 6, 2015

(54) CONTACT ELEMENT FOR PLUG-IN CONNECTOR SOCKET

(75) Inventors: Yingtao Wang, Guangdong (CN); Junmin Guo, Guangdong (CN)

(73) Assignee: Harting Electronics GmbH, Espelkamp (DE)

( * ) Notice: Subject to any disclaimer, the term of this patent is extended or adjusted under 35 U.S.C. 154(b) by 89 days.

(21) Appl. No.: 13/879,607

(22) PCT Filed: Nov. 3, 2010

(86) PCT No.: PCT/CN2010/078366

§ 371 (c)(1),
(2), (4) Date: Apr. 15, 2013

(87) PCT Pub. No.: WO2012/058807

PCT Pub. Date: May 10, 2012

(65) Prior Publication Data

US 2013/0210247 A1 Aug. 15, 2013

(51) Int. Cl.

| | |
|---|---|
| ***H01R 13/64*** | (2006.01) |
| ***H01R 12/71*** | (2011.01) |
| ***H01R 12/57*** | (2011.01) |
| ***H01R 13/631*** | (2006.01) |
| *H01R 13/11* | (2006.01) |

(52) U.S. Cl.

CPC ..... *H01R 12/714* (2013.01); *H01R 12/57* (2013.01); *H01R 13/6315* (2013.01); *H01R 13/113* (2013.01)

USPC ..... 439/250

(58) Field of Classification Search

CPC ..... H01R 13/6315

USPC ..... 439/246, 249, 250, 251, 252

See application file for complete search history.

(56) References Cited

U.S. PATENT DOCUMENTS

| | | | | |
|---|---|---|---|---|
| 2,603,681 | A * | 7/1952 | Salisbury | 439/58 |
| 2,999,998 | A * | 9/1961 | Cole | 439/252 |
| 3,374,979 | A | 3/1968 | Coldren et al. | 248/223 |
| 3,427,419 | A * | 2/1969 | Findley, Jr. | 200/255 |

(Continued)

FOREIGN PATENT DOCUMENTS

| | | | |
|---|---|---|---|
| CN | 1369937 | 9/2002 | H01R 13/62 |
| CN | 1369937 A | 9/2002 | |

(Continued)

OTHER PUBLICATIONS

International Search Report and Written Opinion issued in corresponding application No. PCT/CN2010/078366, dated Aug. 11, 2011 (8 pgs).

*Primary Examiner* — Ross Gushi
(74) *Attorney, Agent, or Firm* — Hayes Soloway P.C.

(57) ABSTRACT

To compensate the lateral offset of an opposing plug, a contact element for a plug-in connector socket has particularly large tolerances. For this purpose, the contact element is embodied in two pieces, a contact spring element for making electrical contact with the opposing plug and a securing element in which the contact spring element is mounted so as to be rotatable about a rotational axis. In contrast to a case in which tolerances depend on deformation of a spring element, by virtue of rotation of the contact spring element no forces act on the soldering points with which the securing element is soldered to a printed circuit board. The contact element is particularly suitable for soldering according to SMT.

17 Claims, 8 Drawing Sheets

(56) References Cited

U.S. PATENT DOCUMENTS

Figure 1A:
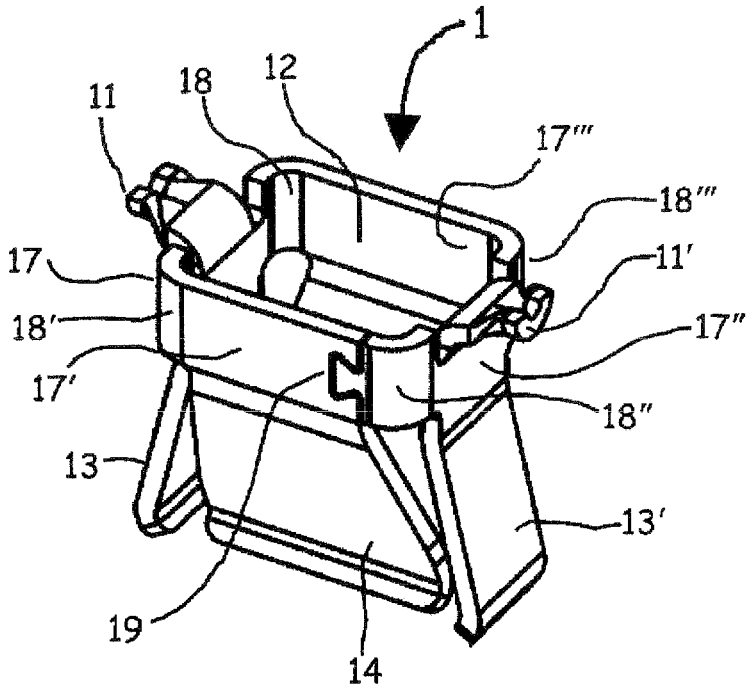

| | | | | |
|---|---|---|---|---|
| 4,423,917 | A * | 1/1984 | Scheingold et al. | 439/249 |
| 4,453,792 | A * | 6/1984 | Bright et al. | 439/251 |
| 4,867,713 | A * | 9/1989 | Ozu et al. | 439/833 |
| 5,098,318 | A * | 3/1992 | Suter | 439/819 |
| 5,419,723 | A * | 5/1995 | Villiers et al. | 439/843 |
| 5,879,177 | A * | 3/1999 | Honma | 439/246 |
| 6,139,347 | A * | 10/2000 | Nebon et al. | 439/251 |
| 6,186,810 | B1 * | 2/2001 | Barnabe et al. | 439/252 |
| 6,325,633 | B1 * | 12/2001 | Ito et al. | 439/34 |
| 6,332,781 | B1 | 12/2001 | Ito | 439/34 |
| 6,497,579 | B1 * | 12/2002 | Garbini | 439/63 |
| 6,511,336 | B1 * | 1/2003 | Turek et al. | 439/249 |
| 6,773,285 | B2 * | 8/2004 | Bernat et al. | 439/246 |
| 6,908,325 | B2 * | 6/2005 | Bernat et al. | 439/246 |
| 6,976,862 | B1 * | 12/2005 | Ormazabal Ocerin | 439/246 |
| 7,581,972 | B2 * | 9/2009 | Daamen | 439/249 |
| 7,795,551 | B2 * | 9/2010 | Narayanan et al. | 200/255 |
| 7,806,711 | B2 * | 10/2010 | Andersen et al. | 439/251 |
| 7,892,050 | B2 * | 2/2011 | Pavlovic et al. | 439/839 |
| 8,007,301 | B2 * | 8/2011 | Andersen et al. | 439/251 |
| 8,123,553 | B2 * | 2/2012 | Lyu et al. | 439/566 |
| 8,177,587 | B2 * | 5/2012 | Takagi et al. | 439/733.1 |
| 8,388,389 | B2 * | 3/2013 | Costello et al. | 439/839 |
| 8,460,009 | B1 * | 6/2013 | Topolewski et al. | 439/65 |
| 8,573,983 | B2 * | 11/2013 | Zieder | 439/8 |
| 8,708,758 | B2 * | 4/2014 | Peng | 439/822 |
| 2002/0111057 | A1 * | 8/2002 | Bernat et al. | 439/246 |
| 2004/0229490 | A1 * | 11/2004 | Bernat et al. | 439/246 |
| 2009/0047814 | A1 * | 2/2009 | Daamen | 439/251 |
| 2010/0317213 | A1 * | 12/2010 | Andersen et al. | 439/251 |
| 2012/0315804 | A1 * | 12/2012 | Wang et al. | 439/816 |
| 2013/0210247 | A1 * | 8/2013 | Wang et al. | 439/83 |

FOREIGN PATENT DOCUMENTS

| | | | | |
|---|---|---|---|---|
| CN | 200956438 | | 10/2007 | H01R 13/11 |
| CN | 200956439 | | 10/2007 | H01R 12/57 |
| CN | 101299496 | | 11/2008 | H01R 13/11 |
| CN | 201199556 | | 2/2009 | H01R 12/57 |
| EP | 1231679 | | 8/2004 | H01R 13/62 |
| EP | 1930987 | | 6/2008 | H01R 12/57 |
| JP | 64-20682 | | 2/1989 | |
| JP | H10255887 | A | 9/1998 | |
| JP | 2002283935 | A | 10/2002 | |
| JP | 2004154456 | A | 6/2004 | |

* cited by examiner

CONTACT ELEMENT FOR PLUG-IN CONNECTOR SOCKET

The invention relates to a contact element for a plug-in connector socket, suitable for soldering to a printed circuit board, wherein the contact element comprises a contact spring element and a securing element, wherein the securing element has at least one soldered connection and wherein the contact spring element has two contact spring limbs for receiving and making electrical contact with a contact pin of an opposing plug.

Such a contact element is required to produce a pluggable, electrically conductive connection between an opposing electric plug and electrical contacts of a printed circuit board.

Prior Art

Document EP 1 930 987 A2 discloses a contact carrier which is suitable for soldering to a printed circuit board carried out using Surface Mount Technology (SMT). The spring contacts of said contact carrier are embodied in two pieces and each have two contact spring limbs which are fixed lying opposite one another in a contact housing.

Document EP 1 231 679 B1 discloses a single-piece socket contact, composed of a securing part and a socket, the socket being a sheet-metal bent part which is permanently connected to the securing part via a common centre plate. By virtue of its elasticity the socket can be pivoted here through a specific angle. This permits compensation, within certain limits of orientation errors of a contact pin of an opposing plug, in particular of a printed circuit board plug, which is to be plugged into the sockets. In this context, the term orientation error comprises both a lateral offset and an incorrect relative angular position between the plug-in connector socket and the opposing plug. In the plugged-in state, the socket contact can compensate a lateral offset of the opposing plug of at maximum approximately 0.4 mm as well as an incorrect angular position of approximately 1.5°.

In practice, these tolerances have not proven adequate for all applications. Furthermore, this compensation of an orientation error is associated with a force effect on the socket contact. This is particularly problematic if the soldering of the contact element to the printed circuit board is carried out using SMT because the corresponding soldering points are then subjected to this force effect.

OBJECT OF THE INVENTION

The present invention is therefore based on the object of specifying a contact element which avoids the disadvantages above and permits compensation of larger orientation errors than is known in the prior art. A force effect on the soldering contacts which results from these large orientation errors is to be avoided here or at least reduced to such an extent that damage to the soldering contacts is ruled out, in particular if they are embodied using SMT.

This object is achieved by virtue of the fact that the contact element is embodied in two pieces, wherein a first piece comprises the contact spring element, and wherein a second piece comprises the securing element, wherein the securing element has two side parts which lie opposite one another, on which the contact spring element is secured and on which it, is mounted so as to be rotatable at least through a limited angle about a rotational axis.

Advantageous embodiments of the invention are specified in the dependent claims.

The invention is a contact element for a plug-in connector socket. This contact element is provided for preferably being soldered to a printed circuit board using SMT, and is capable of compensating a relatively large lateral offset of an opposing plug.

A significant advantage of this invention is that even when these large tolerances are used, no additional forces, or only sufficiently small additional forces, are produced on the soldered connections, which ensures that the soldered connections are not damaged.

The offset is compensated here by the rotation of the contact spring element, which has the advantage that no mechanical stresses are produced as a result.

It is advantageous that the securing element has two parallel side parts lying opposite one another because in this embodiment, the securing element can be manufactured using punching and bending technology. It is particularly advantageous here if the two side parts each have a free-standing end each with a first cut-out which comprises an insertion region and a securing region directly adjoining the insertion region and if the contact spring element has two corresponding rotational arms because these rotational arms can be inserted into the respective securing regions via the respective insertion regions during mounting.

It is also advantageous if such a securing region is of at least partially circular design because as a result each rotational arm is mounted so as to be rotatable in the associated securing region.

It is also advantageous if the insertion region is arranged at the free-standing end of the side part, is open towards the free-standing end and is provided with sliding-on rounded portions because this ensures simple insertion of the respective rotational arm.

It is also advantageous if the contact spring element has an essentially rectangular contact opening, surrounded by four side faces, preferably two short side faces and two long side faces, wherein in each case one of the two rotational arms is integrally formed on to two side faces lying opposite one another, preferably onto the two short side faces. In this context, "essentially rectangular" means that the side faces are each predominantly composed of a straight part and are bent at their rounded corner regions, adjoining other side faces, by 90°. The contact spring limbs can then adjoin the straight part of the two other side faces, preferably the two long side faces, which lie opposite one another. As a result, the contact spring element can be embodied using punching and bending technology.

It is also advantageous that the two contact spring limbs extend, starting from their respective side faces, essentially in the plugging direction of the opposing plug which is to be plugged in, i.e. they each have a free-standing end region which points in the plugging-in direction of the opposing plug and therefore in the same direction as a contact pin of this opposing plug. Towards this end region, said free-standing end regions are shaped such that they initially extend slightly towards one another. At the free-standing end region, the two contact spring limbs are rounded in opposite directions in order to make contact with the contact pin of the opposing plug which is preferably a flat design and is to be inserted through the contact opening. This ensures a large contact area between the contact spring element and the contact pin. It is especially advantageous here if the contact spring limbs are wider than the contact pin because in this way an offset of the opposing plug can also be compensated by pushing the contact pin along the contact face in this direction.

It is also particularly advantageous if the side part has a second cut-out which adjoins the first cut-out in a direction which is opposed to the free-standing end because this increases the elasticity of the side part. In this way, during the mounting, the rotational arms of the contact spring element, which are inserted at the free-standing end of the side part, can initially elastically widen the first cut-out by pressing on the sliding-on rounded portions in order to slide into the securing region and be rotatably secured there after relaxation of the side part. In the mounted state, each rotational arm is therefore arranged in one of the two securing regions, wherein the rotational axis extends through the two securing regions and axially through the two rotational arms.

It is also advantageous if the securing element additionally has at least one, preferably two soldering pins because the contact element can therefore be plugged conventionally through the printed circuit board and soldered thereto.

In a further advantageous embodiment, the securing element is suitable for soldering using SMT, wherein mixed forms are also possible, said forms consisting of the fact that the securing element can be soldered as a Surface Mount Compatible (SMC) component either using SMT or in a conventional manner with its soldering pins. This has the advantage that the contact element can be used particularly flexibly depending on the requirement.

In a further advantageous embodiment, the contact spring element has two lateral limbs in addition to the two contact spring limbs. These two lateral limbs are each arranged at right angles to the two contact spring limbs in each case at the straight part of two side faces, preferably the short side faces. Starting at their respective side faces, they extend essentially along the plugging direction of the opposing plug which is to be plugged in, i.e. the lateral limbs each possess a free-standing end region which points in the plugging-in direction of the opposing plug. Towards this end region, they are shaped so as to initially extend slightly away from one another. The lateral limbs are shaped so as to be bent in towards one another at their free-standing end region, with the result that convex rounded portions are produced at their end regions, which point away from one another and are therefore suitable for making electrical contact over a large area with the two side parts of the securing element as soon as the contact spring element is inserted into the securing element.

In the mounted state of the contact element, this has the advantage that the contact spring element produces further electrical contact with the securing element over the comparatively large contact faces between the lateral limbs of the contact spring element and the side parts of the securing element, in addition to the electrical contact between the rotational arms and the side parts. This increases the conductivity considerably between the contact spring element and the securing element compared to electrical contact which is produced exclusively through the contact points between the rotational arms and their respective securing regions. At the same time, the lateral limbs can mechanically stabilize the contact spring element in the securing element to a large degree by virtue of their force effect, opposed to one another, against the respective side parts of the securing element.

Furthermore, in order to reduce the manufacturing costs it is advantageous if the contact spring element is embodied in one piece. In particular, the contact spring element is punched out from a spring-elastic material and shaped using punching and bending technology.

In order to reduce manufacturing costs it is also advantageous if the securing element is embodied in one piece. The securing element is preferably punched out from a spring-elastic material, in particular from the same material as the contact spring element, and shaped using punching and bending technology.

The two contact spring limbs of the contact spring element are advantageously embodied so as to be symmetrical with respect to one another. In particular it is advantageous if the entire contact spring is embodied so as to be mirror-symmetrical with respect to a first plane of symmetry because in this way only minimum stresses are produced when an opposing plug is plugged in inside the contact element, and the contact pin of the opposing plug is centred in an optimum way during the plugging-in process.

The plug-in connector socket also includes an insulating body. This insulating body is preferably embodied in the form of a right parallelepiped and advantageously has at least one connecting opening on one side, which is provided for the purpose of mounting on the printed circuit board. During mounting, the contact element which is composed of a contact spring element and a securing element is inserted into the insulating body through this connecting opening. Furthermore, during the mounting of the plug-in connector socket on a printed circuit board, contact is formed between the at least one soldered connection of the respective contact element and the printed circuit board through the contact window.

In one preferred embodiment, the insulating body has a plurality of different chambers which are each provided for receiving a contact element.

Furthermore, each chamber has boundary faces in which the contact element is secured after mounting and through which its extension is limited. In one preferred embodiment, elastic deformation of the side part can be prevented by the shape of the chamber, as a result of which the contact spring element is fixed in a captive fashion in the securing element.

In a further preferred embodiment, the chambers have stop elements which are preferably arranged on the boundary faces. These stop elements have the advantage that during mounting the contact element cannot be inserted deeper than provided into the respective chamber because parts of the contact element abut against the associated stop elements when the provided position is reached. These parts of the contact element can be formed, for example, by special edges which are produced by a particularly advantageous shape of the contact spring limbs and/or of the lateral limbs. In particular, the special shapes are present at the corner regions between the contact spring limbs and the lateral limbs.

In a further advantageous embodiment, the insulating body has guide pins which, during mounting onto a printed circuit board, are inserted into guide cut-outs in the printed circuit board provided for that purpose in order to be secured there in a positively locking fashion and to fix the insulating body on the printed circuit board. Furthermore, the insulating body has supporting legs which abut against the printed circuit board in the mounted state. Between these supporting legs the insulating body preferably has windows which serve to provide ventilation and to permit visual observation of the soldering points while the SMT soldering is being carried out.

In one particularly advantageous embodiment, two plug-in connector sockets can be soldered from different sides onto a printed circuit board which can be equipped on two sides, and contact can be made between their respective sides and opposing plugs which, on the one hand, saves space and, on the other hand, permits two different plugging directions.

In one advantageous embodiment, one design according to the invention permits incorrect angular positions of up to 12°. Accordingly, a lateral offset of the plugged-in opposing plug of 1 mm at a right angle to the rotational axis and at a right angle to the plugging direction is possible. It is also advantageous if the contact spring element is wider than the contact pin of the opposing plug because the plug-in connector socket can then also compensate a lateral offset of the opposing plug in the direction of the rotational axis and at a right angle to the plugging direction by virtue of the fact that the contact pin which is of preferably flat design is arranged offset between two contact limbs, which are in contact with it, in the direction of the contact faces thereof.

EXEMPLARY EMBODIMENT

Figure 1B:
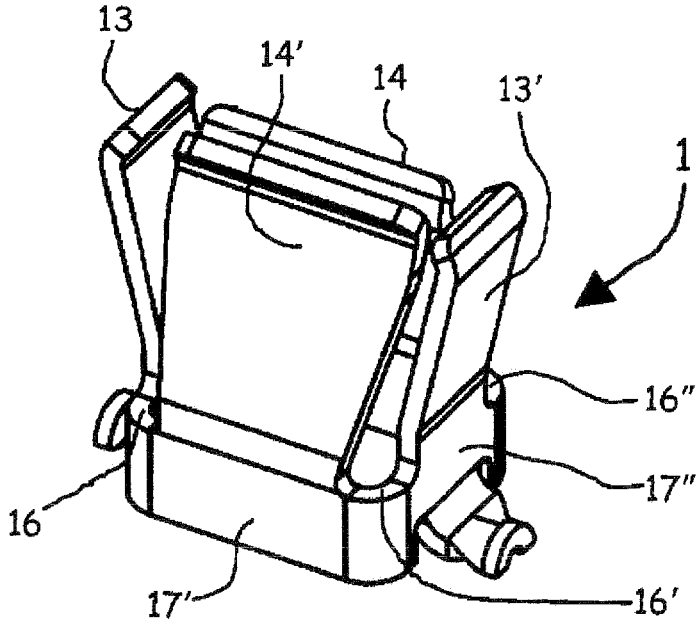
Figure 2A:
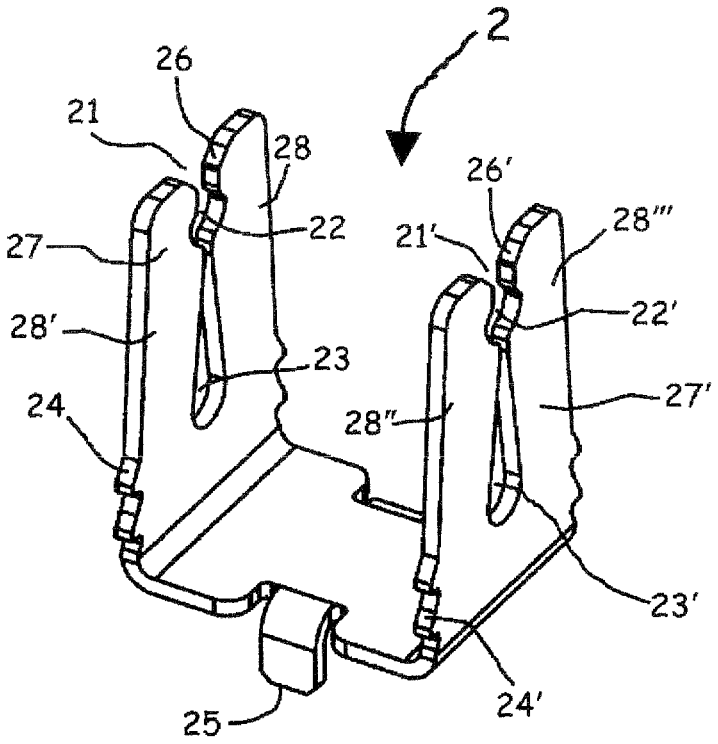
Figure 2B:
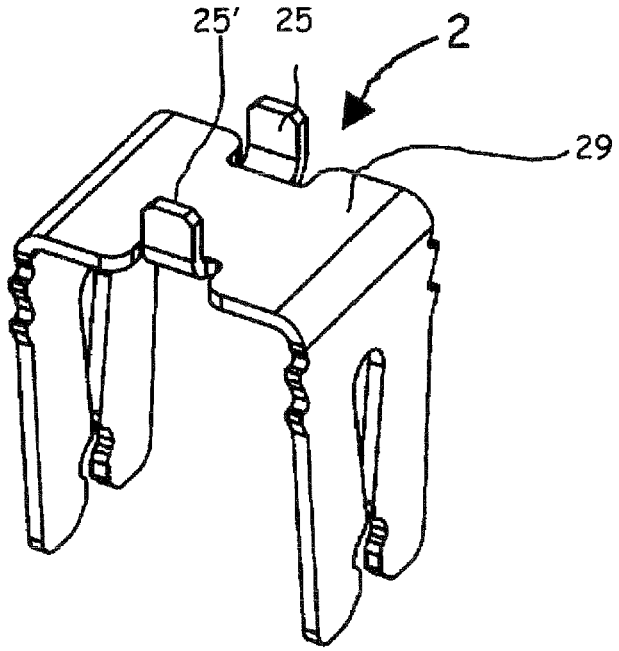
Figure 3A:
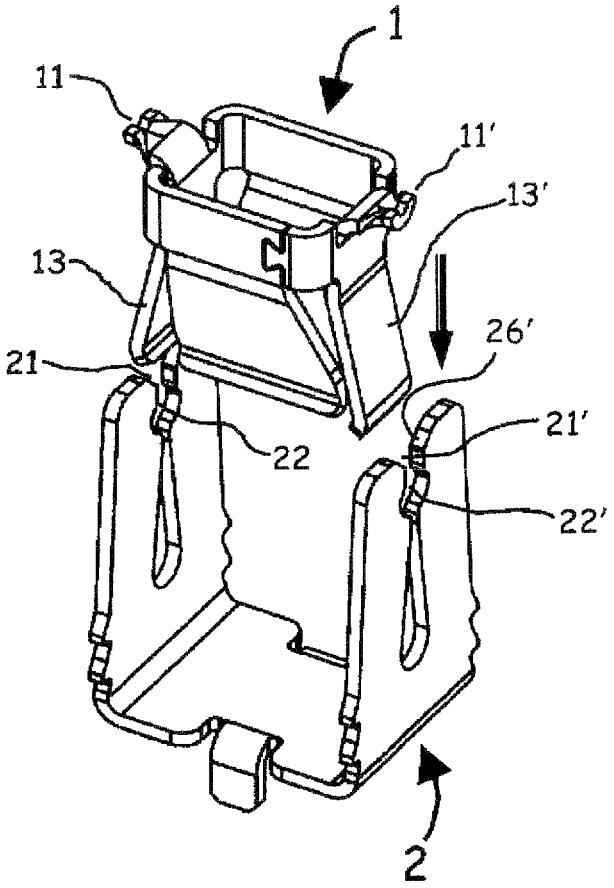
Figure 3B:
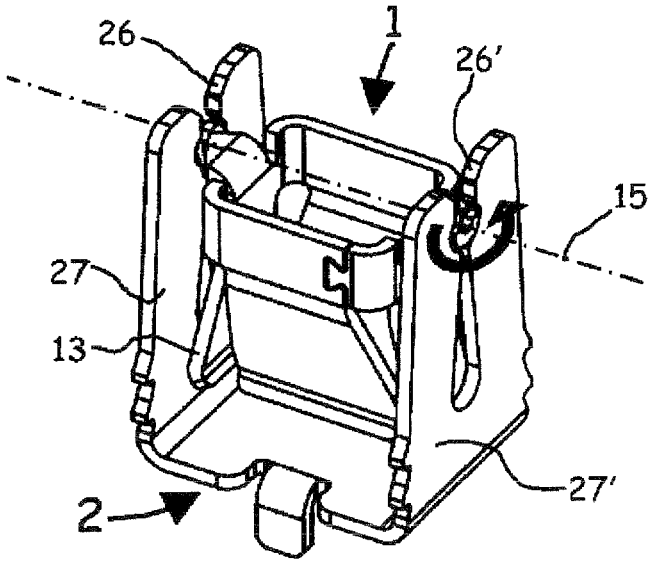
Figure 4A:
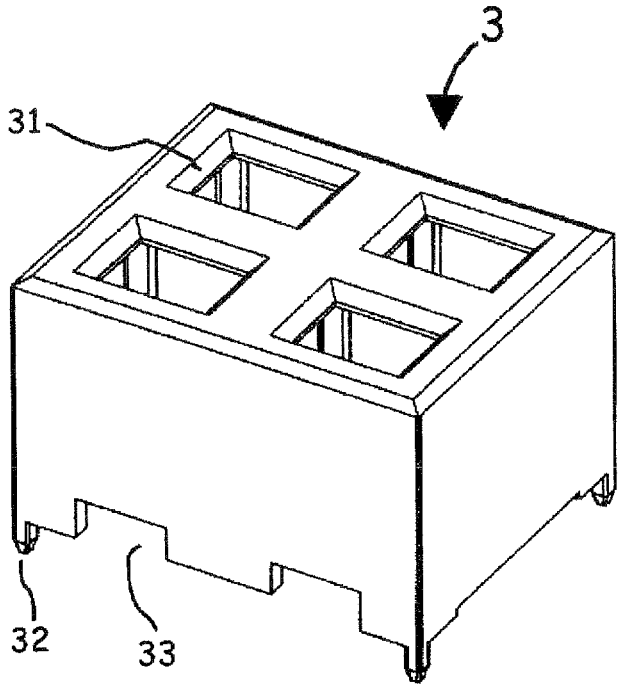
Figure 4B:
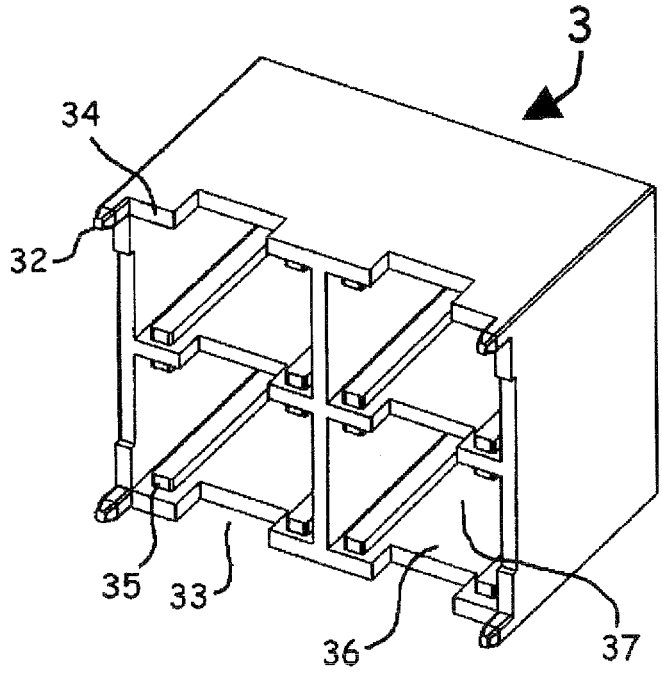
Figure 5A:
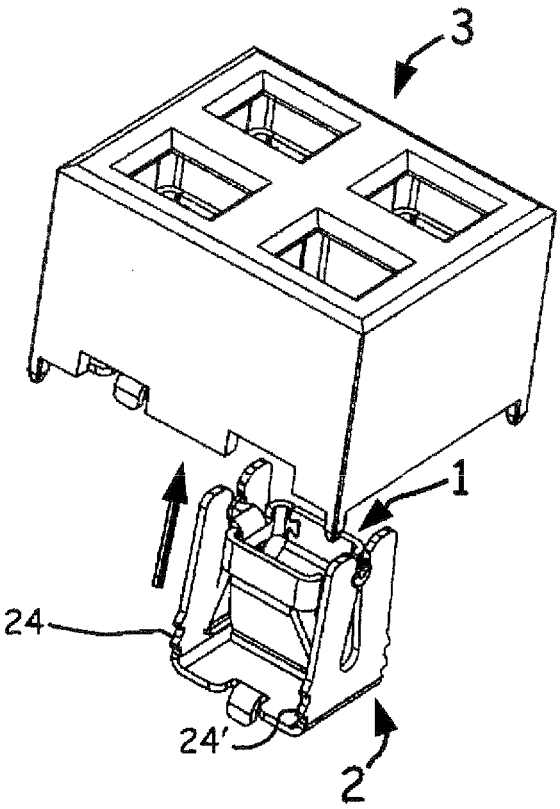
Figure 5B:
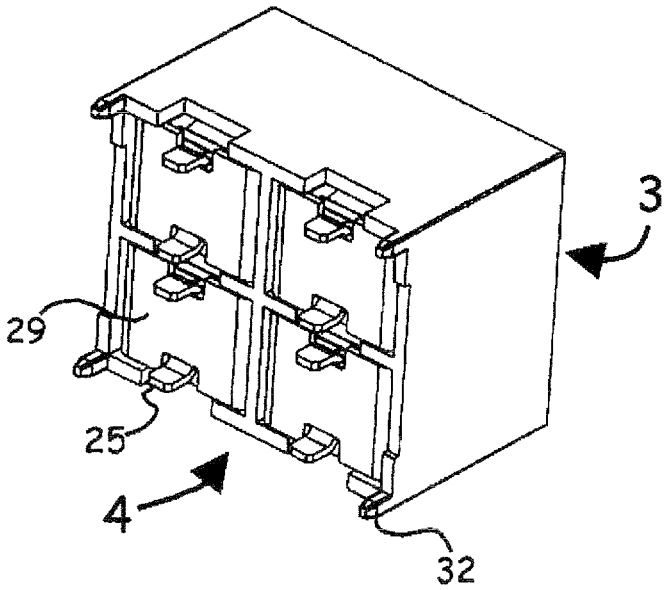
Figure 6:
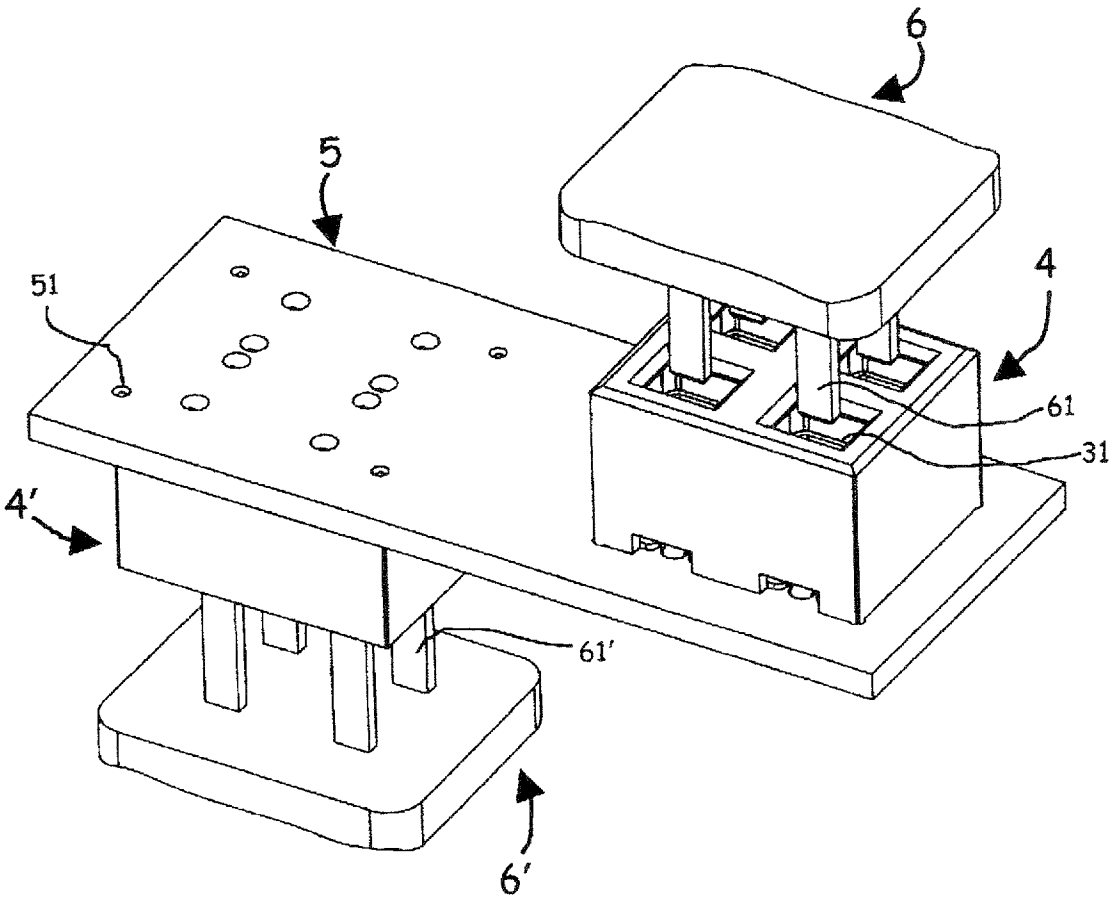
Figure 7A:
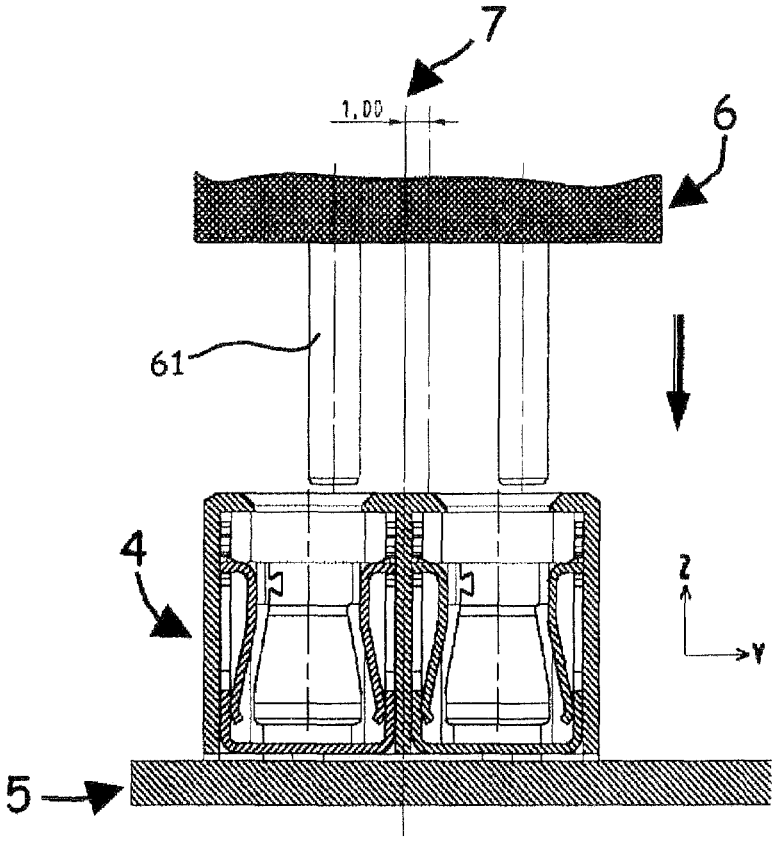
Figure 7B:
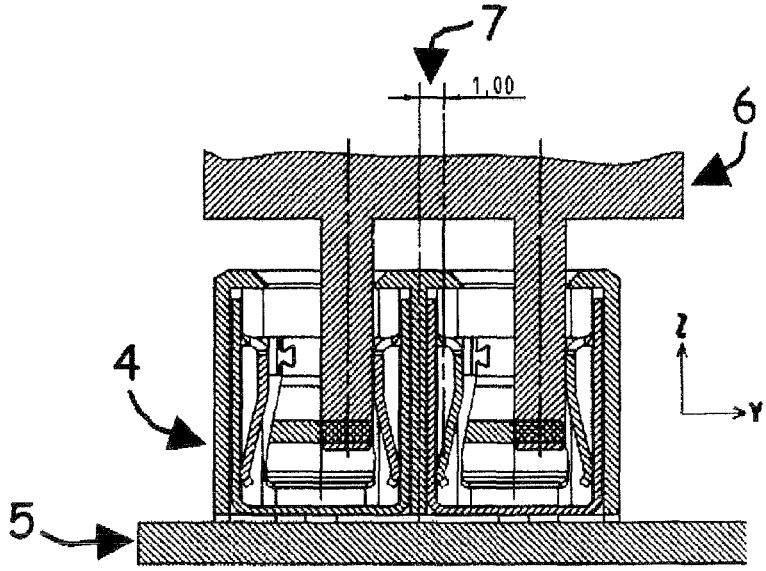
Figure 8A:
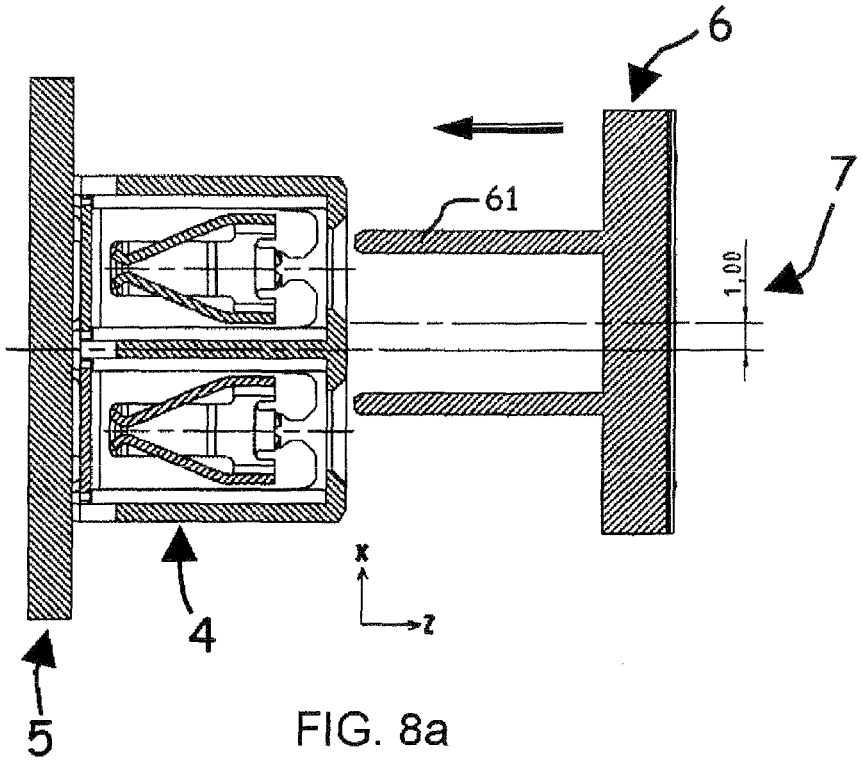
Figure 8B:
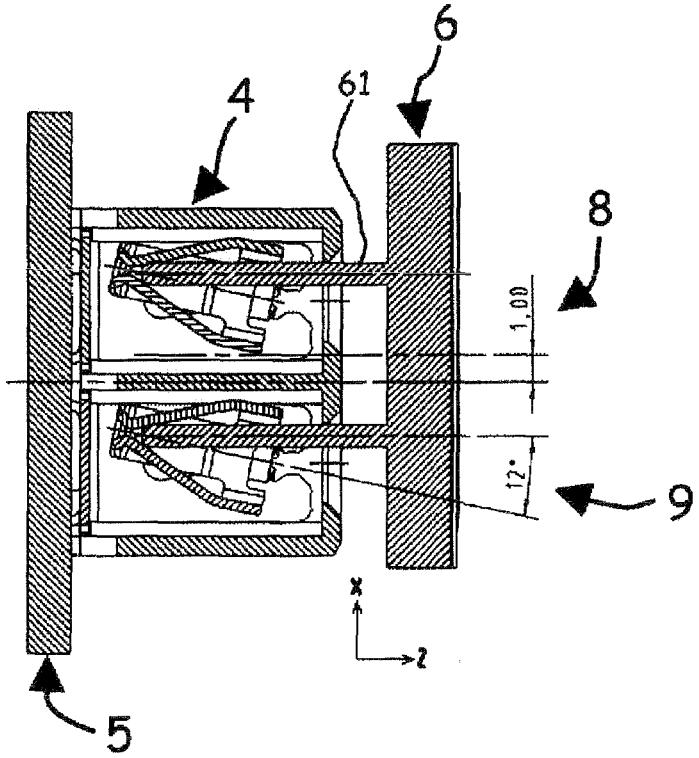

A first exemplary embodiment of the invention is illustrated in the drawings, in which:

FIG. 1*a* shows a contact spring element with a view of a contact opening,

FIG. 1*b* shows the contact spring element with a view of two contact spring limbs and two lateral limbs, FIG. 2*a* shows a securing element with a view of two side parts, FIG. 2*b* shows the securing element with a view of two soldering pins, FIG. 3*a* shows a contact element in the non-mounted state, FIG. 3*b* shows the contact element in the mounted state, FIG. 4*a* shows an insulating body with a view of four contact windows, FIG. 4*b* shows the insulating body with a view of four connecting openings, FIG. 5*a* shows a plug-in connector socket in the non-mounted state, FIG. 5*b* shows the plug-in connector socket in the mounted state, FIG. 6 shows a printed circuit board which is equipped with plug-in connector sockets on two sides, and two associated opposing plugs during the plugging process, FIG. 7*a* shows a cross section through a printed circuit board which is equipped with a plug-in connector socket, and an opposing plug which is offset laterally in the Y direction during the plugging process, FIG. 7*b* shows a cross section through the printed circuit board which is equipped with a plug-in connector socket, and a plugged-in opposing plug which is offset laterally in the Y direction, FIG. 8*a* shows a cross section through the printed circuit board which is equipped with a plug-in connector socket, and an opposing plug which is offset laterally in the X direction during the plugging process, and FIG. 8*b* shows a cross section through the printed circuit board which is equipped with the plug-in connector socket, and a plugged-in opposing plug which is offset laterally in the X direction.

FIG. 1*a* illustrates a single-piece contact spring element 1 in an oblique viewing direction of the contact opening 12, said contact spring element 1 being manufactured from a spring-elastic and electrically conductive material using punching and bending technology. The contact element 12 extends in its cross section essentially rectangularly, i.e. it is surrounded by four side faces 17, 17', 17", 17''', two side faces of which form in each case a first side pair 17', 17''' or a second side pair 17, 17". These four side faces 17, 17', 17", 17''' are formed from a strip-shaped region of the spring-elastic and electrically conductive material by virtue of the fact that the strip-shaped region is bent at four rounded corner regions 18, 18', 18", 18''' through 90° in each case and is joined together again at a front and a rear end 19, for example via a key and a slot 19. In this context, the two side faces of each side pair 17, 17"/17', 17''' are each of equal length and are each arranged parallel to one another and lying opposite one another. Furthermore, the two side faces of the first side pair 17', 17''' are arranged at a right angle with respect to the two side faces of the second side pair 17, 17". The side faces of the first side pair 17', 17''' are longer than the side faces of the second side pair 17, 17".

Furthermore, the contact spring element 1 has, on the two side faces of the second side pair, two rotational arms 11, 11' which are arranged on a common rotational axis 15.

The contact spring element 1 has in each case one contact spring limb 14, 14' adjacent to the two side faces of the first side pair 17, 17'''. These two contact spring limbs 14, 14' extend, starting from their respective side face 17, 17''', essentially in the plugging direction of an opposing plug 6 which is to be plugged in and are oriented so as to initially extend slightly towards one another in this direction in order to extend in a rounded fashion in the opposite direction at a free-standing region, i.e. they are shaped so as to be bent away from one another again at their end regions, as a result of which convex rounded portions are produced at their faces which are turned towards one another. Furthermore, the two contact spring limbs 14, 14' extend symmetrically with respect to one another, with the result that their convex rounded portions lie opposite one another and therefore form in each case a large electrically effective contact area with the contact pin 61, to be inserted between them, of the opposing plug 6.

The contact spring element 1 has in each case one lateral limb 13, 13' adjacent to the two side faces of the second side pair 17, 17". The lateral limbs 13, 13' are arranged symmetrically with respect to one another and extend, starting from their respective side face 17, 17", essentially in the plugging direction of a contact pin 61 of an opposing plug 6 which is to be plugged in. In this direction, they are oriented so as to initially extend slightly away from one another. At their free-standing end region, they are shaped so as to be bent towards one another, with the result that convex rounded portions, which point away from one another, are produced at the end regions of the lateral limbs. The lateral limbs 13, 13' are therefore suitable for making electrical contact over a large area with two side parts 27, 27' of a securing element 2 as soon as the contact spring element 1 is inserted into the securing element 2.

FIG. 1*b* shows the contact spring element in an oblique viewing direction with a view of the two contact spring limbs 14, 14' and the two lateral limbs 13, 13'. From this viewing direction, three special edges 16, 16', 16" are also clearly visible. From the symmetry of the contact element 1 it is apparent that a fourth special edge is present but is concealed by the contact spring limb 14' from this perspective. These special edges are produced by virtue of the fact that in the region of the four rounded corner regions 18, 18', 18", 18''', neither the contact spring limbs 14, 14' nor the lateral limbs 13, 13' directly adjoin the four side faces 17, 17', 17", 17'''. As a result, the special edges 16, 16', 16" at the corner regions 18, 18', 18", 18''' are arranged between the contact spring limbs 14, 14' and the lateral limbs 13, 13'.

FIG. 2*a* and FIG. 2*b* illustrate the securing element 2 from different views. In FIG. 2*a*, the two side parts 27, 27' which lie opposite one another can be seen particularly clearly with their cut-outs. The first cut-out is composed of an insertion region 21, 21' and a securing region 22, 22'. The second cut-out 23, 23' directly adjoins the first cut-out and extends over more than half the length of the respective side part 27, 27'. Each side part 27, 27' is divided by its first and second cut-outs 23, 23' into two partial limbs 28, 28', 28", 28'''. This considerably increases the elasticity of the respective side part 27, 27'.

The securing element has two soldering pins 25, 25'. The securing element can be plugged with these soldering pins through a printed circuit board and soldered thereto. Furthermore, the securing element has a contact face 29 which is illustrated in FIG. 2*b* and with which it can be alternatively soldered using SMT.

The securing element 1 has barbs 24, 24' with which it is secured in an insulating body 3 after insertion therein.

FIGS. 3*a* and 3*b* show the contact element before and after its mounting, which consists in the insertion of the contact spring element 1 into the securing element 2. When the rotational arms 11, 11' are pressed into the insertion region 21, 21', the rotational arms 11, 11' press the sliding-on rounded portions and therefore the partial limbs, 28, 28'/28", 28''' elastically apart from one another and therefore widen the first cut-out elastically, with the result that the rotational arms 11, 11' are pressed into the respective securing regions 22, 22' and are secured there by relaxation of the side part, i.e. by rebounding of the partial limbs 28, 28'/28", 28'''.

FIG. 3*b* illustrates a rotational axis 15 about which the contact spring element 1 is held in the securing element 2 so as to be rotatable at least through an angle of 12°. For this purpose, the rotational arms 11, 11', which are semicircular in cross section, are mounted so as to be correspondingly rotatable in the at least partially circular securing region 22, 22'. The rotational axis 15 accordingly extends through the two rotational arms 11, 11' and the associated securing regions 22, 22'.

The lateral limbs 13, 13' of the contact spring element 1 press, with their convex rounded portions which are directed outwards, i.e. facing away from one another, against the side parts 27, 27' of the securing element 2. On the one hand, this mechanically stabilizes the contact spring element 1 in the securing element 2. On the other hand, this also provides a large electrical contact face and as a result particularly high electrical conductivity between the contact spring element 1 and the securing element 2. During the rotation of the contact spring element 1, the lateral limbs 13, 13' slide along on the side parts 27, 27' of the securing element and therefore permit rotation of the contact spring element 1 through an angle of up to 12°, without the effective contact face being reduced in size in the process.

FIG. 4*a* illustrates an insulating body 3 with a view of four contact windows 31. These contact windows are provided for the insertion of the contact pin 61 of the opposing plug 6 into the insulating body 3.

FIG. 4*b* illustrates the insulating body with a view of four connecting openings 37. The insulating body 3 is embodied in the shape of a right parallelepiped and has four chambers which are provided for receiving one contact spring element 1 each. The chambers have boundary faces 36, between which the contact element is secured after being received and through which it is limited in its extension.

The four connecting elements 37 serve for the insertion of one contact element into each one of these chambers. Furthermore, such a connecting opening 37 serves to make contact with the contact element, inserted into the insulating body 3, on a printed circuit board 5.

The insulating body 3 has, in these chambers, stop elements 35 which are preferably arranged on the boundary faces 36. These stop elements 35 have the advantage that during mounting, the contact element cannot be inserted deeper into the respective chamber than provided because the special edges 16, 16', 16" of the contact element abut against the respectively associated stop elements 35 when the provided position is reached.

The insulating body 3 has four guide pins 32 which are provided for being inserted, during mounting of the insulating body 3 on a printed circuit board 5, into cutouts which are arranged therein. Furthermore, the insulating body 3 has supporting legs 34 which, in the mounted state, abut against the printed circuit board 5. Between these supporting legs 34, the insulating body 3 has windows 33 which serve to provide ventilation and permit visual observation of the soldering points while the SMT soldering is being carried out.

FIG. 5*a* shows a plug-in connector socket in a non-mounted state; this is because the contact element, composed of the contact spring element 1 and the securing element 2 fixed therein, has not yet been inserted into the insulating body 3 in this illustration.

FIG. 5*b* shows the plug-in connector socket in a mounted state in which the contact element is already inserted into the insulating body 3 and is secured in the insulating body 3 with the barbs 24, 24'. Contact can be made with the soldering pins 25 and the contact faces 29 through the connecting openings 37.

FIG. 6 shows a printed circuit board which is equipped on both sides with one plug-in connector socket 4, 4' in each case. Furthermore, the associated opposing plugs 6, 6' are illustrated schematically in the plugging-in process. Accordingly, the contact pins 61, 61' of said opposing plugs 6, 6' are directed at the contact windows 31 of the respective plug-in connector socket 4, 4'.

FIG. 7*a* illustrates a cross section of the printed circuit board 5 through the Y/Z plane together with an opposing plug 6, slightly offset laterally, in a plugging-in process, said printed circuit board 5 being equipped with a plug-in connector socket 4. The lateral offset 7 is 1 mm in the Y direction.

FIG. 7*b* illustrates a cross section of a printed circuit board 5 through the Y/Z plane together with an opposing plug 6, which has been plugged in slightly offset laterally, said printed circuit board 5 being equipped with a plug-in connector socket 4. The lateral offset 7 is also 1 mm in the Y direction in the plugged-in state. The contact pin 61 which is of flat design is pushed between the contact spring limbs 14, 14' along their common contact faces with respect to its normal, i.e. central, plugging position.

FIG. 8*a* illustrates a cross section of a printed circuit board 5 through the Z/X plane together with an opposing plug 6, slightly offset laterally, in a plugging-in process, said printed circuit board 5 being equipped with a plug-in connector socket 4. The lateral offset 8 is 1 mm in the X direction.

FIG. 8*b* illustrates a cross section of a printed circuit board 5 through the Z/X plane together with an opposing plug 6, which has been plugged in slightly offset laterally, said printed circuit board 5 being equipped with a plug-in connector socket 4. The lateral offset 8 is also 1 mm in the X direction in the plugged-in state. Accordingly, the contact spring element 1 is rotated in the securing element 2 through 12° about the rotational axis 15. Even though an angular offset does not usually occur with this design of the plug-in connector socket, it is apparent from this illustration that with such a contact element an angular offset of up to 12° can be compensated.

LIST OF REFERENCE SYMBOLS

1 Contact spring
11, 11' rotational arm
12 contact opening
13, 13' lateral limb
14, 14' contact spring limbs
15 rotational axis
16, 16', 16" special edges
17, 17', 17", 17''' side faces
18, 18', 18", 18''' rounded corner regions
2 securing element
21, 21' insertion region

22, 22' securing region
23, 23' second cut-out
24, 24' barbs
25 soldering pins
26, 26' sliding-on rounded portions
27, 27' side parts
28, 28', 28", 28'" partial limbs
29 contact faces
3 insulating body
31 contact window
32 guide pins
33 window
34 supporting leg
35 stop element
36 boundary faces
37 connecting openings
4 plug-in connector socket
5 printed circuit board
51 guiding cut-outs
6 opposing plug
61 contact pin
7 offset in Y direction
8 offset in X direction
9 angular offset in X direction

The invention claimed is:

1. A contact element for a plug-in connector socket, suitable for soldering to a printed circuit board, wherein the contact element comprises a contact spring element and a securing element, wherein the securing element has at least one soldered connection and wherein the contact spring element has two contact spring limbs for receiving and making electrical contact with a contact pin of an opposing plug, wherein the contact element is embodied in two pieces, wherein a first piece comprises the contact spring element and has opposed rotational arms about which the contact element is constrained to rotate, and wherein a second piece comprises the securing element, wherein the securing element has two side parts which lie opposite one another having opposed slotted apertures therein receiving respective opposed rotational arms, wherein the contact spring element is rotationally secured to the securing element such that the contact spring element is secured to and is mounted for rotation on said securing element, so as to be constrained to rotate at least through a limited angle about a rotational axis defined by said opposed rotational arms.

2. The contact element according to claim 1, wherein the two side parts each have a free-standing end, on each of which a first cut-out is arranged, wherein this first cut-out comprises an at least partially circular securing region.

3. The contact element according to claim 2, wherein the first cut-out additionally has at the free-standing end of the side part an insertion region with sliding-on rounded portions.

4. The contact element according to claim 3, wherein the two side parts each have a second cut-out which directly adjoins the first cut-out by which each side part is divided into in each case two partial limbs in order to increase an elasticity of the respective side part.

5. The contact element according to claim 3, wherein each rotational arm is introduced into the associated securing region via the sliding-on rounded portions of the respective insertion region, through elastic deformation of said insertion region.

6. The contact element according to claim 1, wherein the contact spring element has an essentially rectangular contact opening, surrounded by four side faces, wherein two side faces which lie opposite one another each have a rotational arm.

7. The contact element according to claim 6, wherein the two rotational arms are attached to the securing element by elastic deformation of the respective side parts.

8. The contact element according to claim 6, wherein each rotational arm is introduced into the associated securing region via the sliding-on rounded portions of the respective insertion region, through elastic deformation of said insertion region.

9. The contact element according to claim 1, wherein the contact spring element additionally has two lateral limbs which each possess a free-standing end region which points essentially in a plugging direction of a contact pin of an opposing plug which is to be plugged in.

10. The contact spring element according to claim 9, wherein the lateral limbs are oriented so as to initially extend slightly away from one another towards their free-standing end region and are shaped so as to be bent in towards one another at their free-standing end region, with a result that convex rounded portions are produced at the end regions of the lateral limbs, which convex rounded portions point away from one another and are therefore suitable for making electrical contact over a large area with the two side parts of the securing element.

11. A contact element for a plug-in connector socket, suitable for soldering to a printed circuit board, wherein the contact element comprises a contact spring element and a securing element, wherein the securing element has at least one soldered connection and wherein the contact spring element has two contact spring limbs for receiving and making electrical contact with a contact pin of an opposing plug, wherein the contact element is embodied in two pieces, wherein a first piece comprises the contact spring element, and wherein a second piece comprises the securing element, wherein the securing element has two side parts which lie opposite one another on which the contact spring element is secured and on which it is mounted so as to be rotatable at least through a limited angle about a rotational axis, wherein the contact spring element has an essentially rectangular contact opening, surrounded by four side faces, wherein two side faces which lie opposite one another each have a rotational arm.

12. The contact element according to claim 11, wherein the first cut-out additionally has at the free-standing end of the side part an insertion region with sliding-on rounded portions.

13. The contact element according to claim 12, wherein each rotational arm is introduced into the associated securing region via the sliding-on rounded portions of the respective insertion region, through elastic deformation of said insertion region.

14. The contact element according to claim 11, wherein the two side parts each have a second cut-out which directly adjoins the first cut-out by which each side part is divided into in each case two partial limbs in order to increase an elasticity of the respective side part.

15. A contact element for a plug-in connector socket, suitable for soldering to a printed circuit board, wherein the contact element comprises a contact spring element and a securing element, wherein the securing element has at least one soldered connection and wherein the contact spring element has two contact spring limbs for receiving and making electrical contact with a contact pin of an opposing plug, wherein the contact element is embodied in two pieces, wherein a first piece comprises the contact spring element, and wherein a second piece comprises the securing element, wherein the securing element has two side parts which lie opposite one another on which the contact spring element is secured and on which it is mounted so as to be rotatable at least through a limited angle about a rotational axis, wherein the contact spring element has an essentially rectangular contact opening, surrounded by four side faces, wherein two side faces which lie opposite one another each have a rotational arm.

16. The contact element according to claim 15, wherein the two rotational arms are attached to the securing element by elastic deformation of the respective side parts.

17. The contact element according to claim 15, wherein each rotational arm is introduced into the associated securing region via the sliding-on rounded portions of the respective insertion region, through elastic deformation of said insertion region.

* * * * *